US005470170A

United States Patent [19]

Lindner

[11] Patent Number: 5,470,170

[45] Date of Patent: Nov. 28, 1995

[54] PAVEMENT MARKERS AND METHOD FOR MAKING

[75] Inventor: Henry Lindner, Elgin, Ill.

[73] Assignee: Elgin Molded Plastics, Inc., Elgin, Ill.

[21] Appl. No.: 315,323

[22] Filed: Sep. 29, 1994

Related U.S. Application Data

[63] Continuation-in-part of Ser. No. 978,907, Nov. 19, 1992, Pat. No. 5,354,143.

[51] Int. Cl.[6] ..... E01F 9/00

[52] U.S. Cl. ..... 404/9; 404/13; 404/14; 404/16

[58] Field of Search ..... 404/9, 11–14, 404/16; 362/153.1, 14, 116; 472/17; 350/109, 100, 103, 101, 97, 67; 116/63 R

[56] References Cited

U.S. PATENT DOCUMENTS

| | | | |
|---|---|---|---|
| 2,666,373 | 1/1954 | Mattson . | |
| 3,485,148 | 12/1969 | Heenan . | |
| 3,499,371 | 3/1970 | Jonnes et al. . | |
| 4,557,624 | 12/1985 | Walker | 404/14 |
| 5,002,424 | 3/1991 | Hedgewick | 404/14 |
| 5,354,143 | 10/1994 | Lindner | 404/12 |

*Primary Examiner*—Ramon S. Britts
*Assistant Examiner*—Pamela A. O'Connor
*Attorney, Agent, or Firm*—Olson & Hierl, Ltd.

[57] ABSTRACT

A pavement marker structure and method for making same is provided wherein a pre-molded base block is clad with an in situ molded cap structure. Use of epoxy resins is avoided, and the pavement marker structure is durable and resists attack by moisture.

7 Claims, 2 Drawing Sheets

PAVEMENT MARKERS AND METHOD FOR MAKING

RELATED APPLICATION

This application is a continuation-in-part of my earlier filed U.S. patent application Ser. No. 07/978,907 filed Nov. 19, 1992, now U.S. Pat. No. 5,354,143.

FIELD OF INVENTION

This invention concerns pavement markers wherein a molded base block is clad with an in situ molded cap structure and includes methods for making the same.

BACKGROUND OF THE INVENTION

In the art of pavement markers, it has previously been common to first mold a top member with an open window for framing in edge overlapping relationship a separately molded plastic lenticular retro-reflective flattened reflector. After the reflector is duly positioned in the window on the back side of the molded top member, a liquified hardening plastic is poured into the back cavity and allowed to harden. The top member with assembled reflector and the hardening plastic can be maintained in a mold during this back side formation process, thereby permitting, if desired, a pattern to be impressed upon the generally flat resulting back face. Such a pattern is intended to enhance marker back face bonding to an adhesive located on the pavement surface.

Unfortunately, this type of pavement marker and the associated method of making suffers from various serious disadvantages. One disadvantage is that the liquified hardening plastic commonly used was an epoxy resin of the bisphenol A/epichlorohydrin type. Epoxy resins have now been found to be undesirable for usage under field conditions such as occur in the marker use environment where such a resin deteriorates and degrades with time resulting in the release to the environment of by-products considered to be undesirable and objectionable.

Another disadvantage is that the liquified hardening plastic tends to degrade the reflector retro-reflective characteristics when placed into direct contact with the reflector back face such as occurs particularly during the molding process. The reflector back face contains molded thereinto the critical facet surfaces by which retro-reflectivity of incident light upon the reflector front face is achieved, as is well known in the art. It was therefore necessary to protect the reflector back face with a separately preliminary applied coating or the like which increased pavement marker manufacturing time and cost.

Another disadvantage is that the resulting so made reflectorized pavement marker tended to have a short useful life even when used only in non-freezing road applications because of the tendency for water and moisture to penetrate around perimeter edges of the back face protected reflector and to interfere with retro-reflectivity owing to small apertures that characteristically existed between reflector edges and adjacent portions of the top member.

The art needs a new and improved pavement marker structure and an associated new method of manufacture which avoids such disadvantages.

SUMMARY OF THE INVENTION

This invention relates to a new and improved pavement marker structure which optionally but preferably contains at least one inset lenticular retro-reflective flattened reflector and to a method for making the same.

The inventive pavement marker structure avoids the afore-indicated disadvantages of the prior art pavement marker structures.

The inventive pavement marker manufacturing method provides an improved, reliable, and simplified fabrication technique.

The pavement markers of this invention are durable and can be produced by injection molding of thermoplastics without using epoxy resins. When a retro-reflective reflector is incorporated into such a pavement marker, it is effectively completely sealed into the marker structure and it is resistive to attack by environmental water and moisture. Thus, long reflector duty life is achieved in marker usage. Also, environmental degradation of a marker with time does not result in environmentally objectionable by-products because epoxy resin is not present.

The inventive marker structure and its method for making can be readily modified, if desired, to incorporate various pavement marker structural improvements, such as frangible hand graspable installation tabs, discrete bottom feet which enhance adhesive bondability without air entainment, or the like.

Other and further objects, aims, purposes, features, advantages, embodiments, applications, variations and the like will be apparent to those skilled in the art from the present teachings taken with the appending drawings and associated claims.

DETAILED DESCRIPTION

Those skilled in the art will appreciate that a pavement marker of this invention can have various desired configurations or shapes. However, a present preference is to employ a pavement marker whose body has a solid, opaque, flattened configuration. The body preferably has a generally continuously curved (or convexly rounded) upper portion and a generally convex perimeter which has an oval, or, more preferably, circular configuration. Preferably also, the pavement marker body has a generally flattened or planar bottom face.

Figure 1:
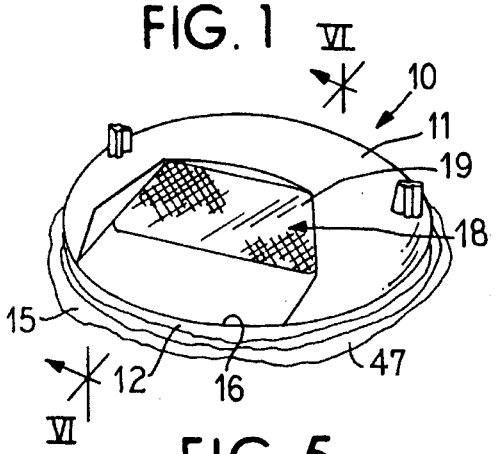
FIG. 1 is a perspective environmental view showing one embodiment of a reflectorized pavement marker of the present invention after installation upon pavement.
Figure 7:
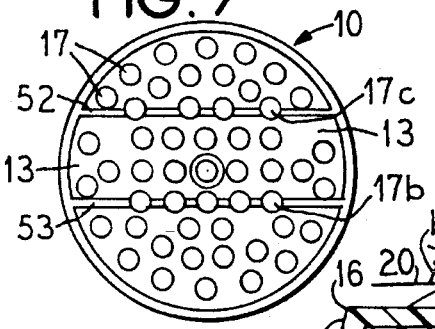
FIG. 7 is a view similar to FIG. 5 but showing the base block bottom after such block is clad with a cap structure as illustrated in FIG. 6.
Figure 6:
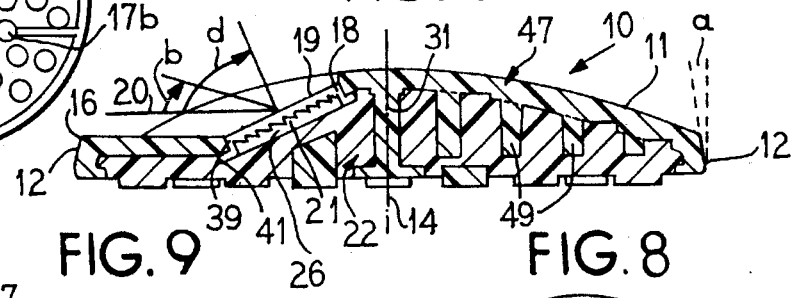
FIG. 6 is a transverse sectional view through the pavement marker of FIG. 1 taken along the line VI—VI showing a base block of FIGS. 2, 3, and 5 in combination with a cap structure and a reflector to comprise such pavement marker.

Referring to the drawings, there is seen in FIGS. 1, 6 and 7 an embodiment 10 of a presently preferred pavement marker of this invention. The pavement marker 10 has a generally convexly rounded upper surface 11 whose facial curvature is preferably comparable to that of a spherical segment. Also, marker 10 has a generally circular perimeter edge or side 12 which upstands somewhat from the periphery of a bottom face 13 and which extends at a slight upward and inwardly inclined angle a relative to a pavement marker 10 central vertical axis 14 (see FIG. 6). Such slight angle of side inclination can vary as desired, but is conveniently and preferably in the range of about 0.4 to about 2.5° with respect to the vertical. This inclination angle a is provided not only to enhance the ease with which a vehicular tire (not shown) can commence a roll over surface 11, but also to enhance the ease of removal of the cap structure of pavement marker 10 from a mold. The corner 16 between the edge 12 and the integrally formed surface 11 is preferably rounded or beveled (not shown in the drawings) for similar reasons.

Typically, the side 12 of pavement marker 10 extends upwardly a short distance from the bottom 13 and also the pavement surface 58 upon which marker 10 is mounted by adhesive or the like as shown in FIG. 1. The rounded upper surface 11 curves upwardly from the corner 16. Maximum pavement marker 10 height is preferably along a center axis 14 and this height is commonly and preferably in the range of about one to about three centimeters although thicker and thinner heights can be employed, if desired.

The diameter of pavement marker 10 can vary. A present preference it to provide a diameter that is in the range of about 5 to about 15 centimeters although larger and smaller diameters can be employed, if desired.

Although pavement marker 10 has a generally flattened off planar bottom face 13, for ease of accurate positioning during mounting and adherence to adhesive means, the bottom face 13 is preferably provided with surface irregularities, preferably patterned, such as an open waffle design or the like. To eliminate air entrapment and improve the adhesive bonding of marker 10, the bottom face 13 is here most preferably provided with a plurality of spaced, shallow, discretely formed projecting feet 17.

The upper surface 11 of pavement marker 10 is convexly and preferably generally uniformly rounded, as indicated, except in areas thereof which are associated with an inset reflector means. It is presently preferred to associate a pavement marker 10 with a reflector means which is retro-reflective in response to incident light striking such a reflector means. The presently preferred retro-reflective reflector means for use in a pavement marker of this invention is a lenticular prismatic molded plastic structure having a smooth planar outer face 19 and an opposed back face 21 in which an array of prismatic hexagonal surfaces is formed. Such a structure is preferably formed of a clear plastic which can optionally be tinted with a color, such as yellow or red, if desired. A suitable and preferred clear plastic is a polycarbonate or an acrylate such as methyl methacrylate. Such reflectors are well known to the art and are believed to be commercially available.

Figure 4:
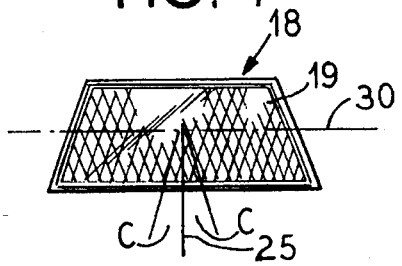
FIG. 4 is a top plan view of the front flat face of a lenticular retro-reflective reflector which is set into the inclined platform defined therefor in the base block of FIGS. 2 and 3.

Such a prismatic lenticular retro-reflective reflector 18 is mounted in top surface 11 as an angularly inclined inset body with the smooth flat outer reflector face 19 exposed, and with the reflector faceting in the rear reflector face 21 being in adjacent spaced relationship to portions of pavement marker 10 as taught herein. The angle of inclination of such a reflector 18 and of its facets is such that the arranged reflector is reflective of incident light, as from approaching vehicular headlights, coming within a predetermined small vertical angle b taken relative to a horizontal (or assumed ground) center line 20 and that extends upwardly therefrom, and also within a predetermined small included horizontal angle c relative to either side of a hypothetical horizontal center line 25 extending through a reflector perpendicularly relative to a reflector hypothetical center line 30 that horizontally extends across the front or outer face 19 of reflector 18 (see FIGS. 4 and 6).

Illustratively, such a vertical angle b can be in the range of greater than 0° to not more than about 0.5° and a present preference is about 0.2 degrees; such a horizontal angle C\c can be in the range of at least about 0.5° to not more than about 2° and a present preference is about 1°; and the angle of inclination d of the reflector 18 (conveniently measured using the front face 19 and the assumed horizontal line 20) can be in the range of about 5° to about 40° with a present preference being in the range of about 20° to about 25°.

Figure 2:
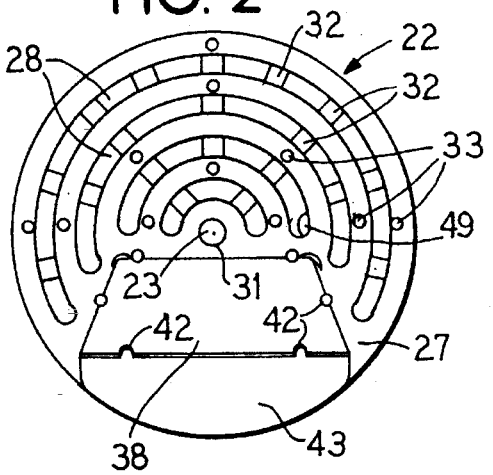
FIG. 2 is a top plan view of one embodiment of a molded base block that is incorporated into the pavement marker of FIG. 1.
Figure 5:
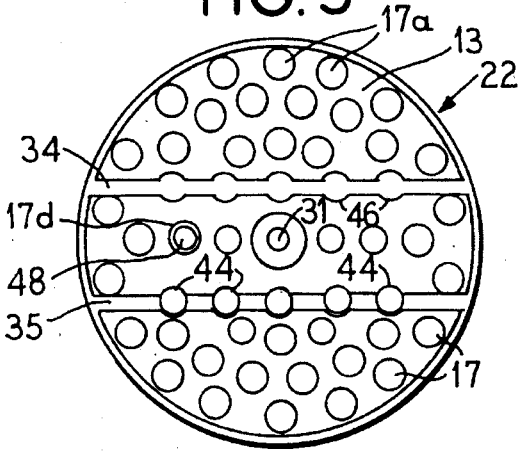
FIG. 5 is a bottom plan view of the base block shown in FIGS. 2 and 3.
Figure 3:
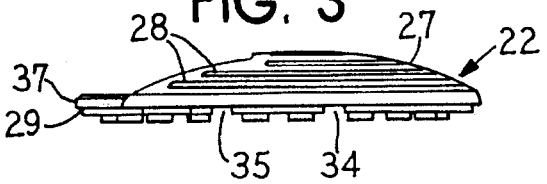
FIG. 3 is side elevational view of the base block of FIG. 2.

The pavement marker 10 utilizes a preliminarily unitarily molded flattened base block 22 (see FIGS. 2, 3 and 5). Block 22 is conveniently made by injection molding or the like a thermoplastic polymer, such as ABS (acrylamide/butadiene/styrene), HIPS (so-called high impact elastomer modified polystyrene), high density polypropylene an acrylate, such as a pigmented methyl methacrylate, or the like. Base block 22 here has a central transversely extending axis 23 that extends normally therethrough and a generally circular edge 24 around its generally flat bottom face 13. A central channel 31 is defined through base block 22 and is here located along axis 23. Also, base block 22 has a generally convex upper surface 27 in which a plurality of troughs 28 are defined. Further, base block 22 has a transversely thickened side 29 in the region between bottom edge 24 and the overlying edge of upper surface 27. Those skilled in the art will appreciate that base block 22 can have various configurations and the such configurations are influenced by the configuration desired in the final product pavement marker made therewith in accord with the teachings of this invention.

In base block 22, it is preferred that the troughs 28 be generally concentrically positioned relative to each other and to the axis 23. Also, it is preferred that the troughs 28 have decreasing depths with radially increasing distance from the axis 23. As an optional preference, a plurality of rib-like members 32 are defined radially across the individual troughs 28 within the body of block 22, and it is preferred that the respective rib-like members 32 in radially adjacent troughs 28 be, where practical, radially and circumferentially aligned with one another so as to provide cumulatively the effect of a series of radial reinforcements for the base block 22. The effect of such radial reinforcements is to resist any cracking tendency in base block 22 under the pressure of a tire or the like when the resulting fabricated pavement marker 10 (which incorporates the block 22) is in use. The rib-like members 32 are preferably arranged (as shown) in circumferentially spaced relationship to each other. Also as an optional preference, a plurality of shallow sided, flat topped upwardly projecting studs 33 are defined on surface 27 and preferably (as shown) such are arranged in circumferentially spaced, radially extending rows. Such studs 33 provide improved surface properties for surface 11 for purposes of over cladding by a cap structure 47 as described herein.

When a pavement marker 10 is being fabricated, the base block 22 is provided with a first flat (planar) area 38 that is inclined relative to axis 23 so as to be inset relative to upper surface 27. The angle of incline corresponds to the angle of inclination chosen preliminarily for a reflector 18, as above discussed. The perimeter of area 38 is trapezoidally configured and corresponds to the perimeter of reflector 18 so that reflector 18 can be inset into the area 38 with the area 38 and reflector 18 being structured so that in the resulting fabricated marker 10, the reflector 18 is inset within the profile curvature surface 11.

The reflector 18 is provided with a unitarily formed, continuous perimetrically extending side wall 39 (see FIG. 6 for example). Preferably, and as shown, the side wall 39 is provided with an outturned flange 41. The transverse height of the side wall 39 is greater than the average thickness of the flattened body of reflector 18. Preferably, this thickness ranges from about 1.25 to about 2.0 times this average thickness, although larger and smaller wall height can be used if desired. Thus, when the reflector 18 is set into the area 38, the reflector 18 is supported against the perimeter of area 38 by the rear edge portions of side wall 39 so that the faceted rear face 21 of reflector 18 is maintained in adjacent but spaced relationship to the surface of area 38 thereby establishing an air space 25 between the faceted back face 21 and the surface of area 38. The transversely upstanding ledge portions about the side edges of area 38 in block 22 that extend between the surface 11 and the surface of area 38 are configured to accommodate reflector 18. However, to aid in holding a reflector 18 in a frictionally engaged, inset relationship relative to area 38 during handling in fabricating and the like, such ledge portions are provided at permetrically spaced intervals with a plurality of unitarily formed lugs 42 that are configured and dimensioned to make slidable and engagable contact with adjacent portions of the outer edge of the flange 41. When in place, rear edge portions of flange 41 also provide a broader contacting engagement with area 38 than would otherwise be achieved by using only the thickness of side wall 39 were flange 41 not present. As those skilled in the art will readily appreciate, many different arrangements can be used. In general, a tight, close fitting relationship is desired and preferred between reflector 18 and base block 22 in the region of area 38 for reasons of exclusion of environmental contaminants especially moisture, in the fabricated pavement marker 10.

Additionally, when a base block 22 for a pavement marker 10 is involved, it is now desired to provide the base block 22 with a second flat (planar) area 43. Area 43 extends preferably perpendicularly relative to the axis 23 and extends continuously and radially between the radially outer edge of the first flattened area 38 and the side perimeter 29. The transversely upstanding ledge portions along the opposed radial side edges of area 43 in block 22 preferably (and as shown) adjoin the corresponding opposed radial side edges of area 38. The dimensions of area 43 vary being influenced by the dimensions of reflector 18 and its angle of inclination, as those skilled in the art will appreciate.

The axially (or transversely) thickened side perimeter 29 of base block 22 is preferably provided with a radially outwardly extending shoulder 37 defined thereon adjacent the upper surface 27.

A plurality of feet **17*a* are preferably formed on bottom face 13 in the molding of base block 22. Also, bottom face 13 has defined therein a pair of grooves 34 and 35. Each groove 34 and 35 extends across bottom face 13 laterally and is in radially spaced relationship to axis 23. The grooves 34 and 35 are also here in spaced, parallel relationship to each other. The depth of each groove 34 and 35 in bottom face 13 is approximately equal to the height of the side perimeter 29 that exists below the shoulder 37 (see FIG. 3**). One or more than two such grooves can alternatively be used, if desired.

To avoid potential heat shrinkage problems in base block 22 in the region of area 38 so that, after molding and cooling of base block 22, the desired dimensions of area 22 are not achieved, it is now preferred to provide base block 22 with a plurality of holes 44 which extend from the bottom face 13 transversely into the base block 22 to terminate at locations that are in spaced adjacent, interior relationship to area 38. The holes 44 are occupied by mold components, such as mold pins or the like, during the molding and formation of the base block 22. The holes 44 avoid the creation of a localized mass of plastic which is large enough to cause heat shrinkage problems. Various arrangements and positions for the holes 44 are possible. In the presently preferred arrangement and as shown, for example, in FIG. 5, the holes 44 are successively positioned along groove 35 in generally equally spaced relationship to each other.

To avoid an open area along groove 35 in bottom face 13 where feet 17 would not otherwise exist after formation of pavement marker 10, the holes 44 are positioned at locations along groove 35 where feet **17*b* (see FIG. 7) are formed during the molding of the cap structure 47 (as herein described), such locations being preferably chosen to correspond approximately with a desired pattern for locating the feet 17. Similarly, to avoid an open area along groove 34 in bottom face 13 where feet 17 do not exist after formation of pavement marker 10, a plurality of relatively shallow holes 46 are similarly formed in bottom face 13 during the molding of the base block 22. These holes 46, like the holes 44, are positioned at locations along groove 34 where feet 17***c* (see FIG. 7) are formed during the molding of the cap structure 47 (as herein described).

For purposes of orientation and alignment of base block 22 with a mold during molding of the cap structure 47, an alignment hole 48 (see FIG. 5) is presently preferably provided in base block 22 which is located in radially spaced relationship to axis 23 and channel 31. In base block 22, this alignment hole 48 is located so as to be formed centrally in the bottom of a single foot 17*d*. To prevent protrusion into the opposed trough 28 on surface 11, a small protrusion 49 into such opposed trough is formed so that a plastic barrier wall is achieved at this location.

With a base block 22 duly positioned in one portion of a mold assembly wherein a cap structure 47 is to be formed, and with a reflector 18 duly located in area 38, the cap structure mold assembly (not shown) is arranged so that when it closed, the front or outer face 19 of the reflector 18 is covered by the mold and is clamped so that, in the cap structure 47 mold cavity (not shown), there is a discontinuity or window defined over the front face 19. At the same time, the mold is configured so that the mold cavity overlaps, preferably only slightly, upon the perimetric side wall portions of reflector 18.

The cap structure 47 is, in effect, in situ molded over and around the top surface 27 and side 29 of the base block 22, and also, in the preferred embodiment of pavement marker 10, over portions of the bottom face 13. Cap structure 47 can be made by injection molding or the like using thermoplastic resins similar to those employed in making the base block 22, or otherwise, as desired. As produced, the cap structure 47 can be considered to clad the base block 22 and is not separatable therefrom.

Characteristically and as shown, the cap structure 47 is conveniently and preferably produced by injecting the plastic from the bottom face 13 through the channel 31 which serves as an injection passageway. The plastic flows over surface 27, around side 29, and into the grooves 34 and 35. The troughs 28, the holes 44 and 46 and the channel 31 are also filled with plastic.

The resulting cap structure 47 is characterized by having a generally dish-configured upper portion whose under surface 48 is generally concave and extends over the base block 22 upper surface 27. Cap structure 47 also has an outer surface 11 which is generally convex. Surface 48 has a plurality of inner projections 49 which fill the troughs 28 and cover the studs 33. Also, the cap structure 47 outside extends over side 29 and covers shoulder 37. Further, the cap structure 47 includes the strips 52 and 53 formed (molded) in the grooves 34 and 35. These strips 52 and 53 also themselves include the formed feet 17*b* and 17*c*. Thus, the cap structure 47 is mechanically interlocked with the base block 22, and the cap structure 47 mechanically seals and locks the reflector 18 into the composite assembly of base block 22 and cap structure 47. Cap structure 47 has a center axis which is substantially coincident with the base block axis 23.

A countersink depression 51 is preferably provided circumferentially about channel 31 in bottom face 13 which further aids in locking cap structure 47 to base block 22.

Figure 9:
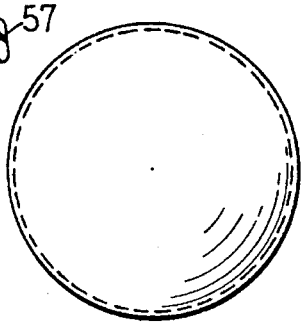
FIG. 9 is a top plan view of another alternative embodiment of a pavement marker of the invention which is similar to that embodiment shown in FIGS. 1–7 but which incorporates no reflector.

As those skilled in the art will appreciate, a pavement marker of the invention can be prepared, if desired, without incorporating any reflector thereinto. For example, one can eliminate the faces 38 and 43 from the surface 27 of a base block 22 (so that the troughs 28 preferably extend in a continuous concentric pattern in base block 22) and mold a cap structure thereover which provides only for a continuously convex upper outer surface thereby to produce a pavement marker structure 60 of this invention (see FIG. 9). Alternatively, one can mold a cap structure with a continuously convex surface over a base block 22; however, such a procedure may result in a slight distortion of the convex surface over the location of the faces 38 and 43 in the base block 22 because of heat shrinkage of the plastic comprising the molded cap structure upon cooling.

Figure 8:
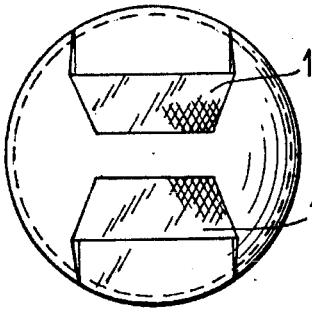
FIG. 8 is a top plan view of an alternative embodiment of a pavement marker of the invention which is similar to that embodiment shown in FIGS. 1–7, but which incorporates two such reflectors as shown in FIG. 4, each such so incorporated reflector being retro-reflective of incident light from an opposite direction relative to the other.

Also, and similarly, a pavement marker of the invention can be prepared, if desired, which incorporates two reflectors, such as two embodiments of reflector 18, so that each reflector is located in opposed relationship to the other and is inset into opposed surface portions of a base block (not shown). Thus, a base block having two pairs of first and second faces 38 and 43 is prepared such that each pair is on a different side of axis 23 and centered along base block diameter. Then, a reflector such as 18 is positioned over each one of the two faces 38. A cap structure is then formed over this base block and the two reflectors with the cap structure including a window positioned over each reflector and further including window edge portions that overlap preferably slightly upon perimeter portions of each reflector (see FIG. 8).

Figure 10:
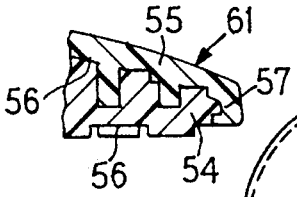
FIG. 10 is a fragmentary vertical sectional view radially taken through an edge region of an alternative embodiment of a pavement marker of the invention which is similar to that embodiment shown in FIGS. 1–7 but which incorporates a base block and cap structure with different respective configuration.

Various mechanical interlocking relationships can be achieved between the base block and the cap structure. One simplified modification is fragmentarily shown in FIG. 10 where a pavement marker 61 is formed with a base block 54 that has an in situ molded cap structure 55 which extends only over the top surface 56 and side edge 57 of the base block 54 without projections of any portions of the cap structure 55 over the bottom face 56 (which is here smooth) of the base block 54. Other modified structures will be apparent to those skilled in the art.

A pavement marker of this invention can be mounted or installed upon a pavement surface by the conventional techniques known to the prior art.

Figure 11:
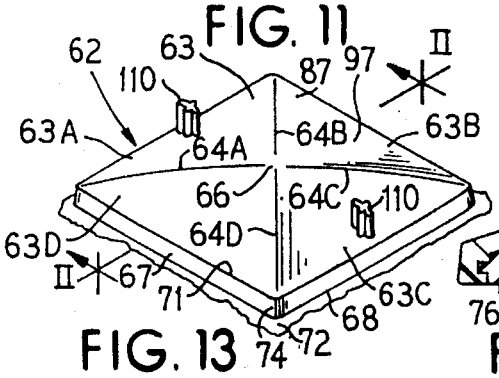
FIG. 11 is a view similar to FIG. 1, but showing an alternative embodiment of a non-reflectorized pavement marker of the present invention after installation upon pavement.
Figure 12:
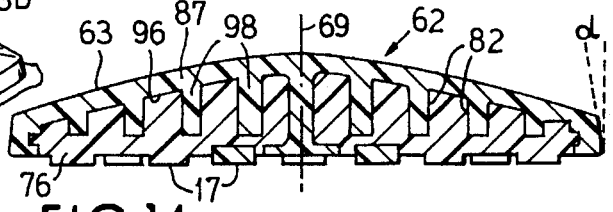
FIG. 12 is a transverse sectional view through the pavement marker of FIG. 11 taken along the line XII—XII of FIG. 11.
Figure 13:
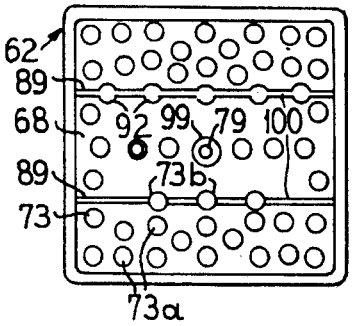
FIG. 13 is a bottom plan view of the pavement marker of FIGS. 11 and 12.

Referring to FIGS. 11–13, there is seen another embodiment 62 of a non-reflectorized pavement marker of the present invention. The pavement marker 62 has a generally convexly rounded upper surface 63 whose facial curvatures define in top plan view four generally equal triangular areas, identified as 63A, 63B, 63C and 63D wherein adjacent respective pairs of such areas adjoin one another along border edges 64A, 64B, 64C and 64D that radially outwardly extend from a center region 66. Marker 62 has a generally square perimeter configuration when viewed in top or bottom plan which configuration is defined by a side 67 that upstands somewhat from the periphery or edge of a bottom face 68 and that extends at a slight upward and inwardly inclined angle d relative to a pavement marker 62 central vertical axis 69 (see FIG. 12). Such slight angle d of side inclination can vary as desired, but is conveniently and preferably in the range of about 0.4° to about 2.5° with respect to the vertical. As in the case of the inclination angle a (above described in marker 10), the inclination angle d enhances both the ease with which a vehicular tire (not shown) can commence a roll over of surface 63 and also the ease of removal of the cap structure 87 of marker 62 from a mold. The longitudinal corner 71 between upper surface 63 and side 67 is preferably rounded or beveled (not shown in the drawings) for similar reasons.

Typically, the side 67 of marker 62 extends upwardly a short distance from the bottom 68 and also from the pavement surface 72 upon which the marker 62 is mounted by an adhesive or the like (as shown in FIG. 11). The rounded upper surface 63 curves upwardly from the corner 71 to the region of axis 69. Maximum marker 62 height is preferably along axis 69 and this height is commonly and preferably in the range of about one to about three centimeters, although thicker and thinner heights can be employed, if desired.

The length of each perimeter segment of side 67 of marker 62 can vary. In the preferred form, the sides are of equal length. A present preference is to provide a side length that is in the range of about 5 to about 15 centimeters, although larger and smaller side lengths can be employed, if desired. At the vertical corner 74 where each adjacent pair of sides meet, the marker 62 is preferably rounded or beveled for reasons similar to those indicated for corner 71.

Although the bottom face 68 is generally flat or planar, for ease of accurate positioning during mounting and adherence to adhesive means, the bottom face 68 is preferably provided with surface irregularities, preferably patterned, such as an open waffle design or the like. To eliminate air entrapment and improve the adhesive bonding of marker 62 to pavement 72, the bottom face 68 is here most preferably provided with a plurality of spaced, shallow, discretely formed projecting feet 73.

Figure 14:
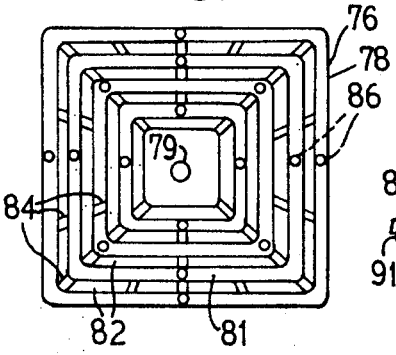
FIG. 14 is a top plan view of one embodiment of a molded base block that is incorporated into the pavement marker of FIGS. 11–13.
Figure 15:
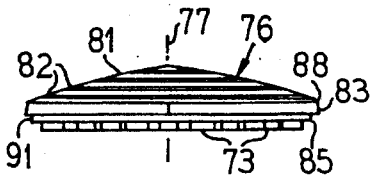
FIG. 15 is a side elevational view of the base block of FIG. 14.

As in the case of the pavement marker 10, the pavement marker 62 utilizes a preliminarily unitarily molded flattened base block 76, such as shown in FIGS. 14 and 15. Block 76 is conveniently made by injection molding or the thermoplastic polymer such as ABS (acylamide/butadiene/styiene), HIPS (so-called high impact elastomer modified polystyiene), high density polypropylene, an acrylate, (such as a pigmented methyl methacrylate), or the like. If desired, the block 76 can be formed of a low grade of thermoplastic resin material that is nonetheless environmentally acceptable. Such a thermoplastic material can be one which has been previously used in some prior application and which is generally unsuitable for reuse in most other applications because of its generally poor or marginal characteristics or composition. Use of a relatively low grade thermoplastic material in a base block, such as block 76 or the like, provides a significant cost saving over what would be the cost of a pavement marker whose body was comprised throughout of the same relatively high grade of thermoplastic such as is now preferably used in my invention for only the cap structure. Such a use of low grade thermoplastic material means that thermoplastic material which would be otherwise typically discarded and used for landfill (or perhaps combusted in an environmentally approved incinerator at high cost) now has a very useful purpose.

The base block 76 here preferably has a central, transversely extending axis 77 which coincides with the axis 69 in the formed marker 62 and which extends normally through the block 76. Block 76 has a generally square configured outer edge 78 whose sides are preferably of equal length relative to each other. The edge 78 is generally adjacent to bottom face 67. A central channel 79 is defined in block 76 that is here preferably located along axis 77. Block 76 has a generally convexly rounded upper surface 81 in which a plurality of concentrically located, spaced, adjacent troughs 82 are defined. Block 76 also has a transversely thickened side region 83 located between the bottom edge 84 of the block 76 and the overlying edge region of upper surface 81. Those skilled in the art will appreciate that variations in the configuration of block 76 are possible and that block configurations are influenced by the configuration desired in the final product pavement marker made therewith in accord with the teachings of the invention.

In base block 76, it is preferred for the troughs 82 to be generally concentrically or progressively positioned in spaced adjacent relationship to one another proceeding outwardly from the axis 77. It is also preferred that the troughs 82 have decreasing depths with increasing trough distance from the axis 77. As an optional preference, a plurality of rib-like members 84 are defined in the surface 81 of block 76 that extend radially outwardly from axis 77 and that extend across the individual troughs 82 within the body of block 22. Preferably, the rib-like members 84 are arranged so as to achieve the effect of being radial reinforcements for the base block 22, thereby to enhance the resistance to cracking in base block 27 under the applied pressure of a vehicular tire or the like when the fabricated pavement marker 62 (which incorporates the block 76) is in use. Preferably, and as shown, the rib-like members 84 are in equally circumferentially spaced relationship to one another. Also, as an optional preference, plurality of shallow sided, flat topped, upwardly projecting studs 86 are defined on surface 81, and preferably such studs 86 are arranged in circumferentially spaced, radially extending rows, as shown in FIG. 14, for example. Such studs 86 provide improved surface association properties for surface 11 for purposes of over-cladding by a cap structure 87, as described herein.

The axially (or transversely) thickened side region 83 of base block 76 is preferably provided with a radially outwardly extending shoulder 88 that is integrally defined thereon adjacent to, and as an extension of, the upper surface 81.

A plurality of feet 73 are preferably formed on bottom face 68 of base block 76 in the molding of the base block 76. Also, as molded, the bottom face 68 of base block 76 has defined therein a pair of spaced, parallel grooves 89. Each groove 89 extends across bottom face 68 and is preferably equally spaced from axis 77. The depth of each groove 89 is approximately equal to the height of the side perimeter 91 that exists below the shoulder 88 and above the edge 85. One or more than two such grooves 89 can alternatively be used in a base block 76, if desired.

To avoid heat shrinkage problems in base block 76, it is now preferred to provide base block 76 with a plurality of holes 92 which extend from the bottom face 68 transversely into the base block 76 to terminate at locations that are in laterally spaced adjacent, relationship. In formation of base block 76, the holes 92 are occupied by mold components, such as mold pins or the like (not shown), and after molding and release from the mold, such components are removed from a base block 76. The holes 92 so formed function to avoid the creation of a localized mass of plastic which could be large enough to cause heat shrinkage problems after molding. Various sizes, arrangements and positions for the holes 92 are possible. In the presently preferred arrangement shown, for example, in FIG. 13, the holes 92 are successively positioned along each groove 89 in generally equally spaced relationship to each other.

To avoid an open area along each groove 89 where feet 73 would not otherwise exist after the formation of a pavement marker 62 with comprised of base block 76 and cap structure 87, the holes 92 are positioned at locations along each groove 89 where feet **73*b* are formed during the molding of the cap structure 87 (as herein described), such locations being preferably chosen to correspond approximately with a desired pattern for the locating the feet 73 on the bottom face 68**.

With a base block 76 duly positioned in one portion of a mold assembly wherein a cap structure 87 is to be formed, the cap structure outer surface forming mold assembly (not shown) is arranged so that when the mold is closed, the cap structure 87 mold cavity is defined mainly over surface 81.

The cap structure 87 is, in effect, in situ molded over and around the top surface 81 and side 83 of the base block 76, and also, as in the preferred embodiment of pavement marker 10, over edge portions of the bottom face 68. Cap structure 87 can be made by injection molding or the like using thermoplastic resins similar to those employed in making the base block 76, or otherwise, as desired. Preferably, when the base block 76 is formed of a low grade thermoplastic resin, the cap structure 87 is formed of relatively higher grade of thermoplastic resin. As produced, the cap structure 87 can be considered to clad the base block 76 and is not separatable therefrom.

Characteristically and as shown, the cap structure 87 is conveniently and preferably produced by injecting the plastic from the bottom face 68 through the channel 79 which serves as an injection passageway. The plastic flows over surface 81, over and around side 83, and into the grooves 89. The troughs 82, the holes 92, the grooves 89 and the channel 79 are filled with plastic.

The resulting cap structure 87 is characterized by having a generally dish-or-bowl-configured upper portion whose under surface 96 is generally concave and extends over the base block 76 upper surface 81. Cap structure 87 also has an outer and upper surface 63 which is generally convex (as indicated). Surface 63 has a plurality of inner projections 98 which fill the troughs 82 and cover the studs 86. Also, the cap structure 87 periphery extends over the side 83 and covers the shoulder 88. Further, the cap structure 87 includes the strips 100 (paired) which are formed (molded) in the grooves 89. These strips 100 also themselves include the formed feet 17*b*. Thus, the cap structure 87 is mechanically interlocked with the base block 76, and is sealed against water and moisture penetration relative to the base block 76.

A countersink depression 99 is preferably provided circumferentially about channel 79 in bottom face 68 which fills with plastic during molding further aids in locking the cap structure 87 to base block 76.

By injecting the cap forming thermoplastic through central axial orifice in the base block, various advantages are achieved. For one thing, the cap-forming thermoplastic becomes uniformly distributed in an umbrella-type of mold filling. If, for example, the thermoplastic were injected into a forming mold from a side gate, the plastic would have to flow essentially uniformly in three directions making it very difficult to achieve uniform and complete distributions of plastic in the mold without side effects, such as burning (localized overheating), or the like. For another thing, the cap is formed with a smooth outer surface, as desired.

Figure 16:
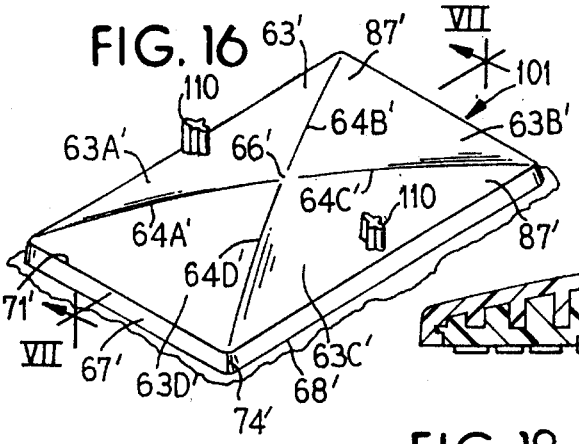
FIG. 16 is a view similar to FIGS. 1 and 11, but showing an alternative embodiment of a non-reflectorized pavement marker of the present invention after installation upon pavement.
Figure 17:
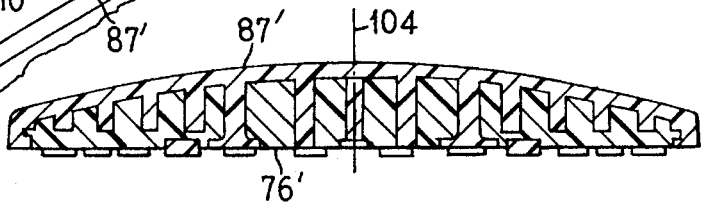
FIG. 17 is a transverse sectional view through the pavement marker of FIG. 16 taken along the line XVII—XVII of FIG. 16.
Figure 18:
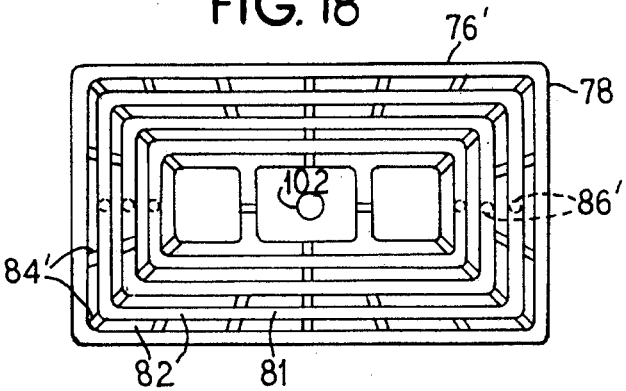
FIG. 18 is a top plan view of one embodiment of a molded base block that is incorporated into the pavement marker of FIGS. 16 and 17.

Referring to FIGS. 16–18, there is seen another embodiment 101 of a non-reflecting pavement marker of the present invention. Although marker 101 has a generally rectangular perimeter when viewed in top or bottom plan, the marker 101 has structural similarities to the marker 62. For convenience, similar components and features are similarly numbered but with the addition of prime marks thereto for identification purposes. The markers 62 and 101 thus have a perimeter configuration which, when viewed in top plan, resembles a regular parallelogram with rounded corners in contrast, for example, to the circular configuration of marker 60.

In order to achieve uniform formation of the cap structure 87' in pavement marker 101, the base block 76' is provided with a central channel 102 which is located along the (hypothetical) vertical transverse center line 103 of the base block 76' (which is also the center line of the marker 101). In molding the cap structure 87' over the base block 76', the hot thermoplastic is injected into the mold cavity (not shown) of the cap structure 87' through the channel 102 and the injected thermoplastic completely and uniformly fills the mold cavity and forms the cap structure 87'.

Optionally but preferably, a pavement marker of this invention is equipped with a pair of frangible holding tabs, such as shown and described in my U.S. Pat. No. 5,310,279. Such a pair of tabs 110 is illustratively shown in each of marker 10, marker 62 and marker 101.

Thus, as those skilled in the art will appreciate, a pavement marker of the invention is prepared, without incorporating any reflector thereinto.

Other and further embodiments and features will be apparent to those skilled in the art from the present teachings and no undue limitations are to be drawn therefrom.

What is claimed:

1. A pavement marker comprising:

(A) a unitarily molded flattened base block having:
  (1) a transversely extending central channel defined therethrough,
  (2) a generally convex upper surface that has a plurality of troughs defined therein,
  (3) a thickened side perimeter, and
  (4) a generally planar bottom surface; and (B) a unitarily molded cap structure that clads said base block, said cap structure having:
  (1) a protrusion that fills said channel,
  (2) a dish-configured portion which
    (a) has a generally concave inner surface that extends over said upper surface and fills said troughs,
    (b) has a generally convex outer surface, and
  (3) a side portion that extends over said side perimeter;

said cap structure having been so molded in situ by flowing a thermoplastic resin through said central channel and over said upper surface and said side perimeter.

2. The pavement marker of claim 1 wherein said base block side perimeter is generally continuously convex and said cap structure is generally continuously convex.

3. The pavement marker of claim 1 wherein said base block and said cap structure each have a perimeter configuration when viewed in top plan resembling a regular parallelogram with rounded corners.

4. A pavement marker comprising:

(A) a unitarily molded flattened base block having:
  (1) a central transverse axis with a channel defined therealong that extends normally through said base block,
  (2) a generally convex upper surface that has a plurality of troughs defined therein which are generally concentrically positioned relative to said axis and which are characterized by decreasing depth proceeding radially outwardly from said axis,
  (3) an axially thickened side perimeter having a radially outwardly extending shoulder defined therein adjacent said upper surface,
  (4) a generally planar bottom surface having at least one groove defined therein, each said groove extending transversely thereacross in radially spaced relationship to said axis and interconnecting at its respective opposite ends with said side perimeter;

(B) a unitarily molded flattened cap structure that clads said base block, said cap structure having:

(1) a central axis that is generally coaxial with said base block, central axis, (2) a generally dish-configured upper portion which:

(a) has a generally concave inner surface that extends over said base block upper surface, (b) has a generally convex outer surface, and (c) has a plurality of inner projections which fill said troughs;

(3) a side portion which (a) extends concavely over said side perimeter and conforms to said shoulder, and (b) has a generally convex outer surface; and (4) at least one bottom strip portion which continuously extends across said bottom surface along each one of said grooves between adjacent adjoining regions of said side portion;

said cap structure having been so molded in situ by flowing a thermoplastic resin through said central channel and over said upper surface and said side perimeter.

5. The pavement marker of claim 4 wherein said base block side perimeter is generally continuously convex and said cap structure is generally continuously convex.

6. The pavement marker of claim 4 wherein said base block and said cap structure each have a perimeter configuration when viewed in top plan resembling a regular parallelogram with rounded corners.

7. A method for making a pavement marker comprising the steps of:

(A) molding a unitary base block which has:

a central channel defined therethrough, a generally convex upper surface that has a plurality of troughs defined therein, a thickened side perimeter, a generally planar bottom surface; and thereafter (B) molding a unitary cap structure over said base block, said cap structure having:

a protrusion that fills said channel a dish-configured portion which extends concavely over said upper surface, fills said troughs and joins said protrusion and which has a generally convex outer surface, and a side portion that extends over said side perimeter.

* * * * *